United States Patent [19]

Yamada

[11] Patent Number: 4,571,851

[45] Date of Patent: Feb. 25, 1986

[54] SLIPPERS

[75] Inventor: Masao Yamada, Akishima, Japan

[73] Assignee: Tama Pack Co., Ltd., Tokyo, Japan

[21] Appl. No.: 634,819

[22] Filed: Jul. 26, 1984

[30] Foreign Application Priority Data

Apr. 14, 1984 [JP] Japan ..... 59-55298[U]
Jun. 18, 1984 [JP] Japan ..... 59-126191

[51] Int. Cl.[4] ..... A43B 3/12; A43B 1/02
[52] U.S. Cl. ..... 36/11.5; 36/9 A
[58] Field of Search ..... 36/11.5, 10, 9 R, 9 A

[56] References Cited

U.S. PATENT DOCUMENTS

| | | | |
|---|---|---|---|
| 1,817,623 | 8/1931 | Hervey | 36/9 A |
| 2,210,475 | 8/1941 | Trimble | 36/9 A |
| 2,614,341 | 10/1952 | Abbott | 36/9 A |
| 2,735,195 | 2/1956 | Eaton | 36/9 R |
| 2,764,823 | 10/1956 | Struble | 36/9 R |
| 3,311,937 | 4/1967 | Conroy | 36/11.5 |

FOREIGN PATENT DOCUMENTS

| | | | |
|---|---|---|---|
| 507652 | 9/1937 | United Kingdom | 36/9 A |

*Primary Examiner*—Henry S. Jaudon
*Assistant Examiner*—T. Graveline
*Attorney, Agent, or Firm*—Ziems, Walter & Shannon

[57] ABSTRACT

A slipper is formed with a sole defined by an outlined edge and having a predetermined length from the front end to the back end thereof, the sole being composed of a toe of a predetermined width defining the front end thereof, a foot inserting part having a predetermined minimum width located adjacent to the toe and progressively and symmetrically enlarged to a predetermined maximum width from the toe toward the back end of the sole, the foot inserting part having pressed bend lines extending slightly inside and along both edges thereof respectively to define the opposite marginal parts which may be spontaneously bent up when pressed to each other, a reduced part having both sides connected to the end of maximum width of the foot inserting part by edges extending with an acute angle from the end of maximum width of the foot inserting part to the reduced part on both sides thereof, a heel part progressively enlarged from the reduced part toward the back end of the sole. The slipper is further formed with instep arranged on the foot inserting part in a strained state, the instep being made of a filmy material and having both sides adhered to the underside of the sole on both sides thereof.

7 Claims, 9 Drawing Figures

SLIPPERS

BACKGROUND OF THE INVENTION

The invention relates to slippers in general, and more particularly relates to the disposable slippers which may be used especially by the people who enjoy travels in a long-distance train or a sight-seeing bus, and by the inpatients as well as the outpatients of a hospital. The slippers are well designed to be comfortable to wear preventing the heels of feet from being soiled on the floorboards. Moreover the slippers may be produced at an extremely low cost and may be easily reclaimed to new products.

So far many slippers have been proposed for the purposes as mentioned above. These slippers, however, have been insufficient to comply with the requirements such as to be comfortable to wear, to prevent the socks from getting dirty on the floorboards, to be produced at a low cost with an efficient productivity, to be easily disposed after the slippers have been used, and so on. It will be proper to explain the prior by way of an example in FIGS. 1 and 2 showing one of the older slippers which is now actually reduced to practice. The slipper 1 has a sole 2 made so narrow as is designed in match with the soles of foot in general, and especially the heel part 2*a* is particularly narrow. The sole 2 is made of a cardboard which is covered with upper and lower sheets 4 of synthetic resin which are welded to each other by heat-treatment along the edge 4*a* of the sole. The slipper 1 has an instep 5, which is made of the same material with that of the cover sheets 4, welded by heat-treatment on both sides 5*b* thereof to the cover sheets 4 at the edge of the slipper. The instep 5 is folded at the intermediate parts 5*a* thereof to maintain the slipper flat when the latter is unused, such that the instep may be unfolded when the slipper 1 is used.

According to the prior art as mentioned above, since the heel part 2*a* is so small and narrow, the heel of foot is liable to protrude out of the heel part 2*a* of the slipper 1 when the user walks around in the places as mentioned above and when the user makes himself at home including his or her legs in the outward directions, for example, in the long-distance train. As the result, the socks are partly pressed against the floorboard and get dirty. It is well known that the travellers in general even in their seats in the long-distance train will relax themselves inclining their legs more or less in the outward directions, instead of strictly posing in their seats. It is therefore a fatal defect for those who have neat habits that the heel part of slipper is small and narrow.

On the other hand, from the viewpoint of manufacture, the sole 2*a* of the conventional slipper 1 is designed irrespectively of the fitness in a sense of economically cutting out the form from a material such as the cardboard. It is therefore unavoidable that there will be left much amount of useless part of the cardboard after the forms have been cut out. Further since it is required that the instep 5 of the slipper 1 is folded at the intermediate parts 5*a* thereof with predetermined angles and predetermined dimensions, such additional manufacturing process and equipment therefor will be needed. Further since the cover sheets 4 is required to be welded by heat-treatment to each other along the edge 4*a* of the sole 2 and also the instep 5 is required to be welded by the same manner on both sides 5*b* thereof to the sheets 4, so many additional manufacturing processes and heat equipment will be needed. As the result, the manufacture cost becomes rather high.

Further from the viewpoint of the disposal after the slippers have been used, since the cover sheets 4 and the instep 5 are made of synthetic resin of a considerable thickness and of considerable dimensions and these may not be recycled, it becomes very difficult to dispose of the used slippers if they are released in a great quantity, for example, by the National Railways Corporation and other railway companies which deal with such slippers. These used slippers will produce a poisonous gas to cause a public hazard in case these are disposed of by way of combustion. In any events, the conventional slipper 1 is very uneconomical in view of the fact that this can not be recycled and fails to contribute to the purpose of material-saving.

BRIEF SUMMARY OF THE INVENTION

The invention has been provided to eliminate the defects and disadvantages of the prior art. It is therefore an object of the invention to provide a slipper having a sole made of a thick paper such as a corrugated cardboard which is progressively tapered from the foot inserting part of the instep to the heel part of the slipper in such a manner that the heel part may be most enlarged to the extent that the heel part is considerably wider than the width of the user's foot in general, to thereby prevent the heel of the user from protruding out of the heel part of the slipper, and thus to prevent the socks of the user from being dirty even if the user walks around, for example, in a long-distance train or relaxes himself inclining his legs in the outward directions in the seat of the train.

It is another object of the invention to progressively enlarge the foot inserting part of the slipper from the toe toward the heel part to enable the user to easily slip the foot inserting part irrespectively of the size of foot, to enable the slipper to spontaneously fit the foot of the user as well as to prevent the slipper from slipping out from the foot of the user while the user is walking around.

It is another object of the invention to provide pressed bend lines at least at the toe and the heel end of the sole so that such parts of the slipper may be spontaneously bent up along the pressed bend lines respectively while the user is walking around, to thereby prevent the toe and the heel end from being caught on the stepped parts of the floorboards, and at the same time to prevent the toe and heel of the user from being dirty even if the floor is more or less wet.

It is another object of the invention to provide pressed bend lines at the sole of the slipper on both sides of the foot inserting part thereof in such a manner that if the user lightly pushes the both sides of the foot inserting part by hand, a strained instep is loosened to enable the user to slip the foot into the foot inserting part of the slipper and simultaneously the parts of the sole on both sides of the foot inserting part are bent up to partly fit the foot of the user, to thereby additionally prevent the foot from being dirty on the floorboard.

It is another object of the invention to provide the instep of the slipper made of an extremely thin film of synthetic resin which will produce little public hazard if the instep is disposed of by way of combustion, thus to make the slipper easily disposable, and which may be printed with any marks or characters for the purpose of, for example, advertisement thus to heighten the commercial quality of the slipper It is still another object of the invention to provide the sole of the slipper made of a thick paper such as a corrugated cardboard which is elastic and keeps warmth to thereby make the slipper comfortable to wear and at the same time to make the slipper reclaimable, thus to contribute to the purpose of material saving.

It is still anothet object of the invention to design the slipper in a form to be most efficiently cut out from the material such as the corrugated cardboard with a minimum waste being left behind and simultaneously heighten the productivity of the slippers.

It is still another object of the invention to determine the dimensions of the specific parts of the sole with predetermined retes respectively, to thereby spontaneously define the total length as well as the respective parts of the slipper, and at the same time to be able to obtain the similar forms of slippers of various sizes fitting the feet of the children as well as of the adults.

It is still another object of the invention to simply adhere the filmy instep to a flat sole in a strained condition to thereby simplify the manufacture of the slipper with an extremely low cost, i.e. approximately a sixth of the cost of the conventional slippers.

In short, the present invention relates to a slipper comprising a sole defined by an outlined edge and having a predetermined length from the front end to the back end thereof, the sole being composed of a toe of a predetermined width defining the front end thereof, a foot inserting part having a predetermined minimum width located adjacent to the toe and progressively and symmetrically enlarged to a predetermined maximum width from the toe toward the back end of the sole, the foot inserting part having pressed bend lines extending slightly inside and along both edges thereof respectively to define the opposite marginal parts which may be spontaneously bent up when pressed to each other, a reduced part having both sides connected to the end of maximum width of the foot inserting part by edges extending with an acute angle from the end of maximum width to the reduced part on both sides thereof, a heel part progressively enlarged from the reduced part toward the back end of the sole; and an instep arranged on the foot inserting part in a strained condition, the instep being made of a filmy material and having both sides adhered to the underside of the sole on both sides thereof.

The other features and advantages of the invention will be apparent from the following description of the preferred embodiments in reference to the attached drawings, in which:

FIGS. 1 and 2 relate to a conventional slipper, wherein

FIGS. 3 through 8 retate to the present invention, wherein

Figure 1:
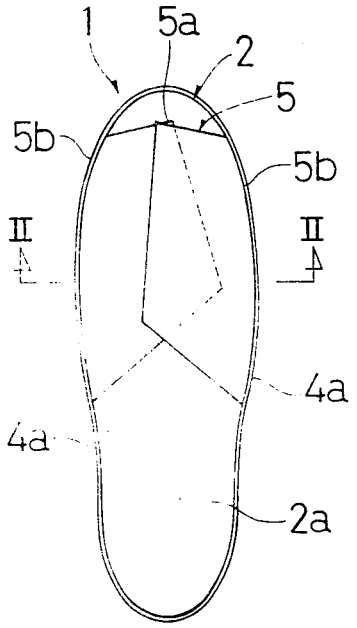
Fig. 1 PRIOR ART
FIG. 1 is a plan view showing the slipper in an unused condition.
Figure 2:
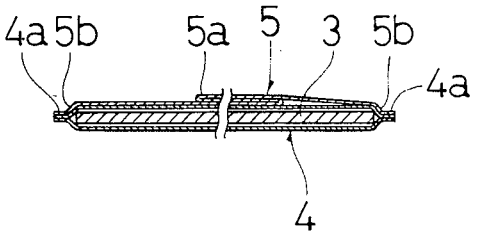
Fig. 2 PRIOR ART
FIG. 2 is a view taken from II—II of FIG. 1.
Figure 3:
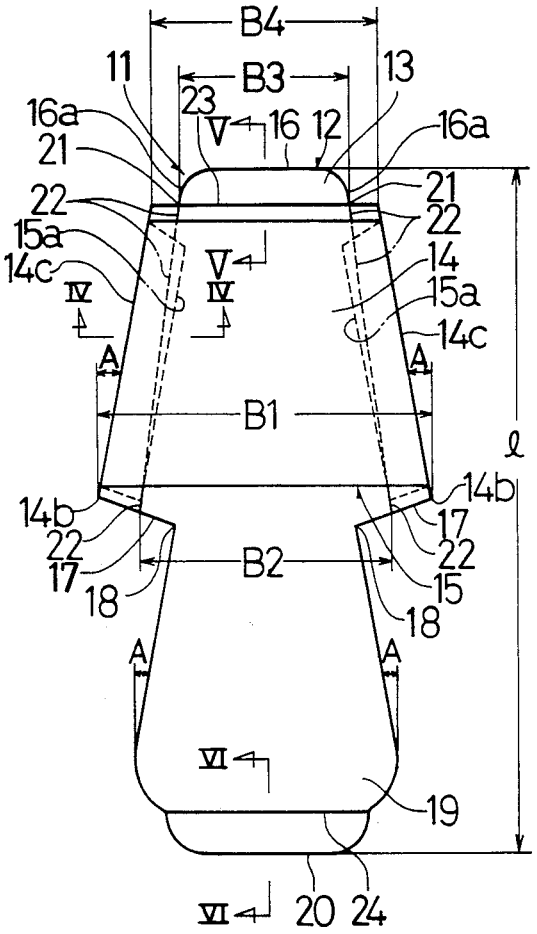
Figure 4:
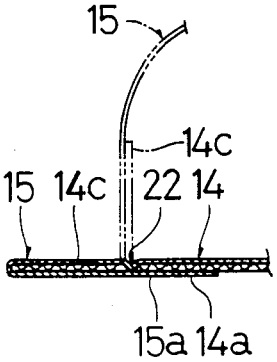
Figure 5:
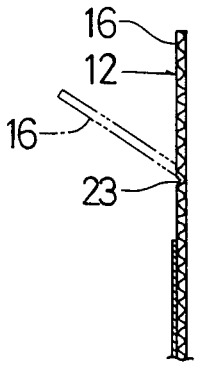
Figure 6:
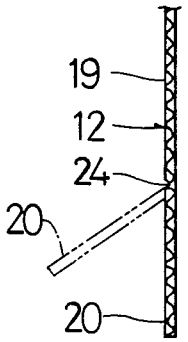
Figure 7:
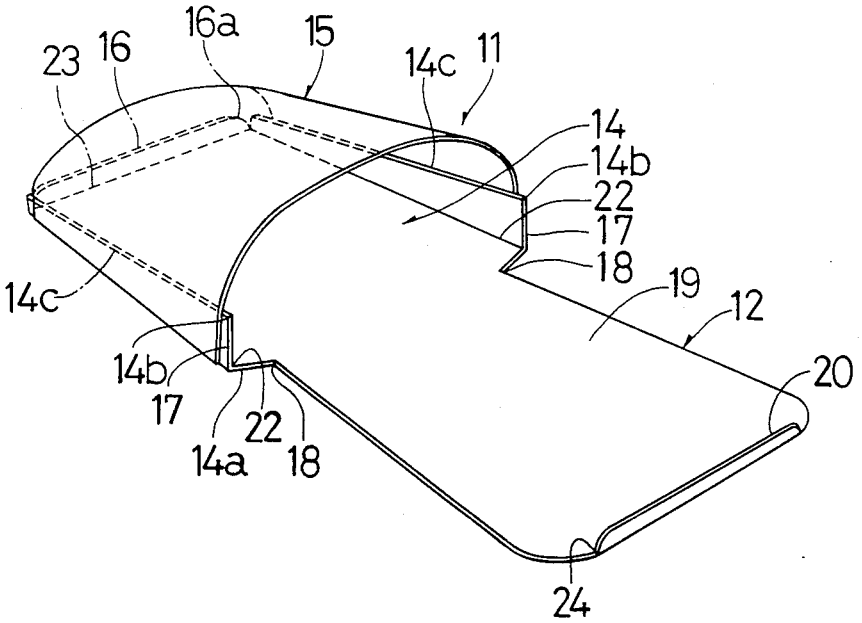

FIG. 3 is a plan view showing a slipper in an unused condition;

FIG. 4 is a view taken from IV—IV of FIG. 3;

FIG. 5 is a vertically sectional partial view taken from V—V of FIG. 3;

FIG. 6 is a vertically sectioned partial view taken from IV—IV of FIG. 3;

FIG. 7 is a perspective view of the slipper; and

Figure 8:
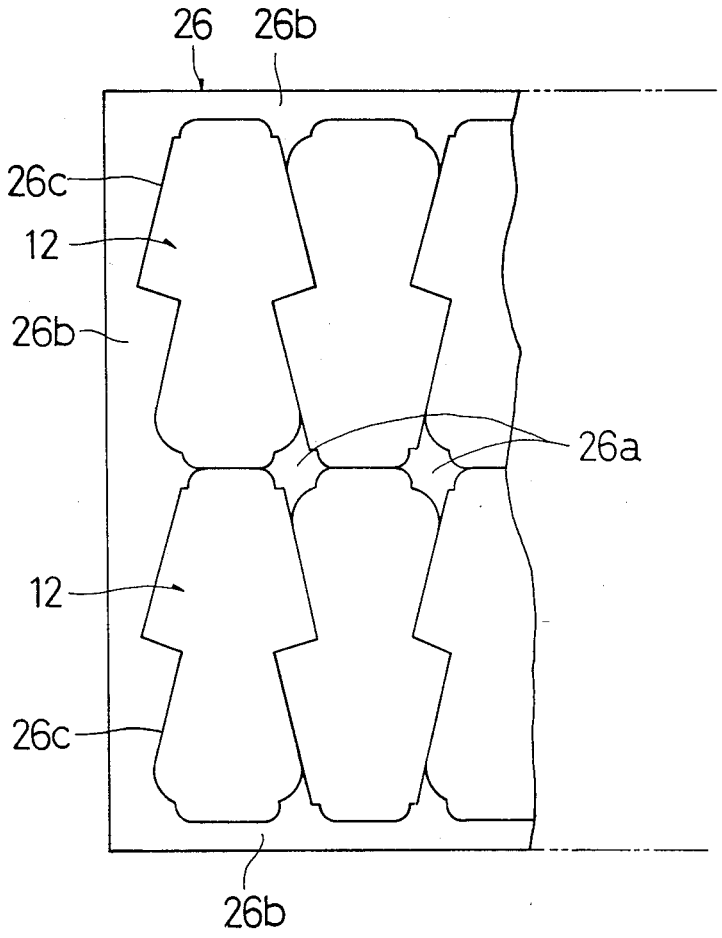
Figure 9:
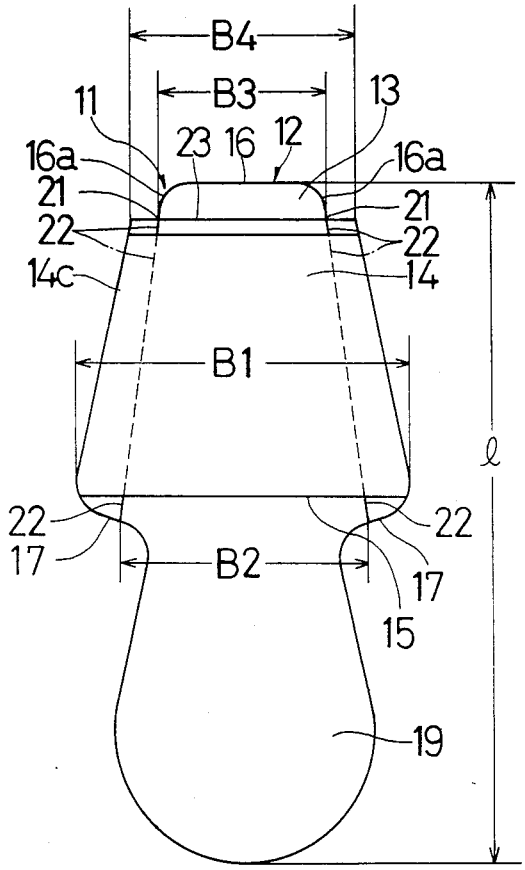

FIG. 8 is a plan view showing a form of the slipper and a manner of cutting out a number of forms from a material; and FIG. 9 is a plan view showing another embodiment of a slipper in an unused condition.

DETAILED DESCRIPTION OF THE INVENTION

The invention will now be described in reference to the embodiment as shown in FIGS. 3 to 7. A slipper 11 is composed of a sole 12 of a length l from the front end to the back end thereof which is made of a thick paper 13 such as a corrugated cardboard, and an extremely thin filmy instep 15 which is placed in a strained condition on a foot inserting part 14 of the sole 12 and has both side ends 15*a*,15*a* adhered to the underside 14*a* of the foot inserting part 14 on both sides 14*c*,14*c* thereof. The sole 12 has a toe 16 of a width B3 defining the front end thereof. The foot inserting part 14 is formed as progressively and symmetrically enlarged with an angle A from the toe 16 toward a heel part 19 of the sole 12 and terminates in an end part 14*b* of maximum width. The sole 12 has a reduced part 18 connected to the end of the maximum width of the foot inserting part 14 by edges 17,17 extending with an acute angle from the end of the maximum width to the reduced part 18 on both side thereof, the reduced part being of approximately the same width with that of the toe 16. The heel part 19 is extended as progressively and symmetrically enlarged with the same angle A with that of the foot inserting part 14 toward the back end of the sole 12. The heel part 19 is provided with an additional heel end part 20 defining the back end of the sole 12. The toe 10 is defined by a transverse juncture 21 between the base 16*a* thereof and the front end of the foot inserting part 14. A pair of pressed bend lines 22,22 are provided as extending from the opposite ends of the juncture 21 to the intermediate points of the acute angled edges 17,17 respectively to define marginal parts on both side of the foot inserting part 14, so that the both sides 14*c*,14*c* of the foot inserting part 14 may be spontaneously bent up along the pressed bend lines 22,22 as shown in FIG. 4 as the slipper is used. A pressed bend line 23 is provided on the transverse juncture 21 so that the toe 16 may be spontaneously bent up as shown in FIGS. 5 and 7, and also a pressed bend line 24 is provided transversely between the end of the heel part 19 and the heel end part 20 so that the latter may be spontaneously bent up as shown in FIG. 6 and 7 as the slipper is used.

Particularly in reference to FIG. 3, the slipper 11 is designed to have the following dimensions: The maximum width B1 of the foot inserting part 14 approximately corresponds to $\frac{1}{2}$ of the length l of the sole 12; The width B2 between the pressed bend lines 22 at the opposite juncture edges 17,17 between the end of maximum width of the foot inserting part 14 and the reduced part 18 approximately corresponds to $\frac{3}{8}$ of the length l of the sole 12; The width B3 of the toe 16 approximately corresponds to $\frac{1}{4}$ of the length of the sole 12; The minimum width B4 of the foot inserting part 14 approximately corresponds to $\frac{1}{4}$ plus 10 mm of the length l of the sole 12. The term "approximately" used in defining the dimensions of the widths B1, B2 and B3 means that there may be a tolerance in these widths between plus 10 mm and minus 5 mm.

The dimensional rates may be applied to the slippers of various sizes in the following ways:

| l | B1 | B2 | B3 | B4 |
|---|---|---|---|---|
| 280 mm | 140 mm | 105 mm | 70 mm | 80 mm |
| 260 | 130 | 97.5 | 65 | 75 |
| 240 | 120 | 90 | 60 | 70 |
| 220 | 110 | 82.5 | 55 | 65 |
| 200 | 100 | 75 | 50 | 60 |
| 180 | 90 | 67.5 | 45 | 55 |
| 160 | 80 | 60 | 40 | 50 |
| 140 | 70 | 52.5 | 35 | 45 |

Manufacture of the slipper is as follows: Particularly in reference to FIGS. 3 and 8, the sole 12 of the slipper is cut out from a material 26 such as a corrugated cardboard. Since the tapering angle A of the foot inserting part 14 is the same with the tapering angle A of the heel part 19, many forms of the sole 12 may be laterally arranged on the material 26 adjacent to each other and in the opposite direction with respect to each other as shown without substantial spaces being remained therebetween. Thus a laterally elongated unit pattern of sole forms is formed, and such unit pattern may be arranged, for example, in two rows adjacent to each other in the longitudinal direction of the sole. It is therefore apparent that the material 26 may be quite economically utilized to the maximum extent only with a minimum amount of waste being remained such as the part **26*b* around the unit patterns and the parts 26*a* between the unit patterns. Moreover the sole 12 may be efficiently manufactured simply by cutting out the same from the material 26 such as a corrugated cardboard, and accordingly the manufacturing cost may be reduced to the minimum extent. Actually the sole 12 may be produced in a large quantity from the material 26 only by preparing a pressing machine having an edge of the shape which is identical with the outline 26*c* of the composite pattern of soles 12 as shown in FIG. 8. The pressed bend lines 22, 23, 24 of the sole 12 may be formed simultaneously when the sole is cut out from the material 26** by the pressing machine.

Then the instep 15, which is made of a polyethylene film by way of example, is adhered to the sole 12 is a strained state by means of a proper automated machine. This adhering operation will be very simple and efficient especially because the instep 15 need not be cared for as to some degree of looseness thereof. Moreover the instep 15 may be utilized for commercial advertisement by printing thereon the name of a company providing the slipper. A name or illustration of a commercial article, an advertising catchphrase, etc.

The slippers 11 thus finished up are shipped in a certain quantity with each pair being superimposed face to face at the underside thereof. In this case, since the instep 15 is extremely thin, and accordingly the slipper 11 is of the thickness substantially of that of the material such as the corrugated cardboard, the slippers 11 will not be bulky and therefore efficient in transportation resulting in cost reduction in the process of transportation.

Usage of the slipper 11 is as follows: The slipper 11 is sold in a pair as superimposed face to face at the underside thereof. A person who bought the slippers 11 presses the slipper by a hand on both sides of the foot inserting part 14 toward each other. Then the opposite edges **14*c* of the foot inserting part 14 are spontaneously bent up at the respective pressed bend lines 22 as shown by the imaginary line in FIG. 4, and the instep 15 is loosened to an extent sufficient enough to allow the user to insert his or her foot thereinto as shown in FIG. 7. As the foot inserting part 14 is properly tapered, the slipper 11 is easy to wear and will not be taken out from the foot while the user is walking. Thus the slipper 11** is designed to be suitable for the children as well as the adults.

While the user is walking, the toe 16 of the slipper 11 is spontaneously bent up at the pressed bend line 23 due to the vertical movement of the ankle, and the heel end part 20 is also bent up at the pressed bend line 24. Therefore the toe 16 and the heel end part 20 will not catch on the steps and the like on the floor, thus to heighten the security of the user and also prevent the foot from getting dirty even if the floor is more or less wet. Further the opposite bent up edges **14*c* of the foot inserting part 14 will give the user a feeling of embracement and a sense of confortability. Further the heel part 19, which is extended as progressively enlarged from the reduced part 18 to the end of the sole 12** and considerably wide, will prevent the foot of the user from getting dirty even if the user make himself or herself at home inclining the legs, for example, in the outward directions.

According to the invention, the widths B1, B2, B3 and B4 of the slipper 11 are determined with predetermined rates respectively with respect to the length l of the slipper. It is therefore apparent that the slippers of different sizes may be very easily manufactured substantially with a similar configuration in a wide range from the children to the adults. The dimentional rates determined by the invention have been obtained as the most suitable ones after the result of many experiments and investigations in pursuing the most comfortable and most practical slippers.

The slippers 11, which have been used, may be collected together to be burnt up in an incinerator because the slippers 11 will not produce a public hazard such as the poisonous gases. Otherwise these slippers may be reclaimed in a new product. A large quantity of slippers 11 deserted, for example, by the National Railways Corporation will have a value of money conversion more or less useful to secure the source of income. At least, the slippers 11 will not be the butts difficult to dispose of.

Now the slipper 11 has been described as having the heel part 19 which is flat at the upper face thereof. The heel part 19 may be provided with a number of projections on the upper face thereof by forming a number of pressed bend lines (not shown) directed from the under face to the upper face of the heel part 19 so as to make the heel part 19 unslippery. Otherwise such slip-proof projections may be provided by applying a liquid synthetic resin to the upper face of the heel part 19 and then drying up the resin.

FIG. 9 shows another embodiment of the invention, wherein the slipper 11 has a heel part 19, end portion of which is defined by an arcuated outline instead of being formed with the pressed bend line 24 and the heel end part 20, and the juncture between the foot inserting part 14 and the heel part 19 is defined by the opposite curved lines 17,17 on both side thereof. With respect to the other parts, the slipper 11 of this embodiment is same with the slipper 11 of the first embodiment.

The invention being thus described, it will be obvious that the same may be varied in many ways. Such variations and modifications with not be regarded as a departure from the spirit and scope of the invention and will be included within the scope of the following claims.

I claim:

1. A slipper comprising a sole defined by an outlined edge and having a predetermined length from a front end to a back end thereof, said sole being composed of a toe portion of a predetermined width defining the front end thereof, a foot inserting part having opposite side edges defining a predetermined minimum width longitudinally spaced from said front end and progressively and symmetrically enlarged to a predetermined maximum width toward the back end of said sole, said foot inserting part having pressed bend lines extending slightly inside and along said opposite side edges thereof respectively to define opposite marginal parts which may be spontaneously bent up when pressed toward each other, said sole having a reduced part connected to said maximum width of said foot inserting part, said reduced part having edges extending at an acute angle from both sides of said maximum width toward the back end of the sole, a heel part progressively enlarged from said reduced part toward the back end of said sole and defining a maximum width adjacent said back end, and an instep arranged on said foot inserting part in a strained condition, said instep being made of a film material and having both sides adhered to said opposite marginal parts of said foot inserting part, said length of said sole being of a dimension aproximately twice as large as that of said maximum width of said foot inserting part when the latter remains flat, said toe portion having a width of a dimension approximately a half of that of said maximum width of said foot inserting part, and said maximum width of said heel part being of a dimension larger than that of said maximum width of said foot inserting part when said opposite marginal parts are pressed toward each other and spontaneously bent up.

2. The slipper as defined in claim 1 wherein said sole is made of a corrugated cardboard.

3. The slipper as defined in claim 1 wherein the width of said toe portion approximately corresponds to $\frac{1}{4}$ of the length of said sole.

4. The slipper as defined in claim 3 wherein the width between said pressed bend lines at the opposite juncture edges between the maximum width of said foot inserting part and said reduced part approximately corresponds to $\frac{3}{8}$ of the length of the sole.

5. The slipper as defined in claim 4 wherein the minimum width of said foot inserting part approximately corresponds to $\frac{1}{4}$ plus 10 mm of the length of said sole.

6. The slipper as defined in claim 5 wherein said toe portion is defined by a pressed bend line traversing transversely of the width of said sole and being inwardly spaced from said front end of said sole, at which said toe may be spontaneously bent up while said slipper is used.

7. The slipper as defined in claim 6 further comprising a part provided between said heel part and the back end of the sole, said part being defined by a pressed bend line traversing transersely of said sole and being inwardly spaced from said back end of said sole, at which said part may be spontaneously bent up while said slipper is used.

* * * * *